US010053250B2

(12) United States Patent
Zhang

(10) Patent No.: US 10,053,250 B2
(45) Date of Patent: Aug. 21, 2018

(54) ADHESIVE TAPE CASE SEALER MACHINE

(71) Applicant: Su-Zhou Xuenuo Mechanical Products Co., Ltd., Jiangsu (CN)

(72) Inventor: Qicang Zhang, Jiangsu (CN)

(73) Assignee: SU-ZHOU XUENUO MECHANICAL PRODUCTS CO., LTD., Jiangsu (CN)

( * ) Notice: Subject to any disclaimer, the term of this patent is extended or adjusted under 35 U.S.C. 154(b) by 393 days.

(21) Appl. No.: 14/778,226

(22) PCT Filed: Apr. 17, 2013

(86) PCT No.: PCT/CN2013/074297
§ 371 (c)(1),
(2) Date: Sep. 18, 2015

(87) PCT Pub. No.: WO2014/146315
PCT Pub. Date: Sep. 25, 2014

(65) Prior Publication Data

US 2016/0090203 A1 Mar. 31, 2016

(30) Foreign Application Priority Data

Mar. 19, 2013 (CN) ..... 2013 1 0086919

(51) Int. Cl.
*B65B 51/06* (2006.01)
*B31B 50/72* (2017.01)

(52) U.S. Cl.
CPC ..... *B65B 51/067* (2013.01); *B31B 50/72* (2017.08); *B31B 50/722* (2017.08)

(58) Field of Classification Search
CPC ..... B65B 7/00; B65B 51/067; B65B 59/04; B31B 50/004; B31B 50/005; B31B 50/72; B31B 50/722
(Continued)

(56) References Cited

U.S. PATENT DOCUMENTS 3,530,025 A * 9/1970 Achterberg ..... B65B 51/067 156/358
4,039,367 A * 8/1977 Warshaw et al. ..... B65B 51/067 156/486
(Continued)

FOREIGN PATENT DOCUMENTS

CN 201211931 3/2009
CN 201367139 12/2009
(Continued)

OTHER PUBLICATIONS

"AccuGlide Taping Head 2+," 3M Corporation, 2006, 2 pages.*
"3M-Matic Adjustable Case Sealer 200a/200a3," 3M Corporation, 2008, 2 pages.*

*Primary Examiner* — Stephen F Gerrity
(74) *Attorney, Agent, or Firm* — Vidas Arrett & Steinkraus

(57) ABSTRACT

An adhesive tape case sealer machine comprises a machine seat (1), an upper machine core provided on the upper portion of the machine seat for sealing the upper part of the case, a lower machine core (3) provided on the lower portion of the machine seat for sealing the lower part of the case, and a conveyor device (4) for conveying the case, the lower machine core being slidingly connected to the machine seat. By sliding the lower machine core with respect to the machine seat, it is easy to pull the lower machine core out from the machine seat, and to quickly replace the adhesive tape for it, so that replacing the adhesive tape is convenient, efficiency of operations is high, and it is more suitable for high-speed, large-scaled assembly link operation.

5 Claims, 5 Drawing Sheets

(58) Field of Classification Search
USPC ..... 53/135.1, 136.1, 136.3, 136.4, 393; 493/116, 117, 478
See application file for complete search history.

(56) References Cited

U.S. PATENT DOCUMENTS 4,520,612 A * 6/1985 Muller ..... B65B 59/04 53/201
4,643,707 A * 2/1987 Marchetti ..... B65B 51/067 156/468
4,658,563 A * 4/1987 Lissoni ..... B65B 59/04 493/117
5,374,326 A * 12/1994 Marchetti ..... B65B 51/067 156/468
5,626,708 A * 5/1997 Vasilakes et al. .... B65B 51/067 156/468
5,701,718 A * 12/1997 Spada ..... B65B 59/04 53/148
5,916,106 A * 6/1999 Chen ..... B65B 51/067 53/136.4
6,135,937 A * 10/2000 Ballos, III ..... B31B 50/00 493/116
7,555,874 B2 * 7/2009 Chu ..... B65B 51/067 493/183
2002/0005258 A1 1/2002 Tsuken et al.
2004/0020165 A1 * 2/2004 Monti ..... B65B 59/04 53/167
2004/0266597 A1 * 12/2004 Melville ..... B65B 59/04 493/149
2012/0216688 A1 * 8/2012 Liu et al. ..... B65B 59/04 100/8
2013/0167489 A1 * 7/2013 Brizzi ..... B65B 59/04 53/582

FOREIGN PATENT DOCUMENTS

CN 201816791 5/2011
CN 102975899 3/2013
CN 203127212 8/2013
DE 29722527 U1 * 3/1998 ..... B65B 9/06
JP 06199321 A * 7/1994
JP 06345016 A * 12/1994
JP 10203510 A * 8/1998
JP 2000203528 7/2000
JP 2002019736 A * 1/2002 ..... B65B 51/067
JP 2003312615 A * 11/2003

* cited by examiner

ADHESIVE TAPE CASE SEALER MACHINE

This is a national stage application of PCT/CN2013/074297, filed Apr. 17, 2013, claiming priority to CN201310086919.2, filed Mar. 19, 2013, the contents of which is hereby incorporated by reference.

TECHNICAL FIELD

The present invention relates to a kind of case-sealing equipment, in particular, an adhesive tape case sealer machine.

BACKGROUND

Products produced in batch production always employ assembly line operation in which each workstation is respectively provided with mechanical equipment to execute automatic processing. And case-sealing equipment is generally provided at the rearmost end of the assembly line to package the products for ease of transport.

The existing case-sealing equipment usually has an upper machine core for sealing the top of the case with the adhesive tape, a lower machine core for sealing the bottom of the case and a conveyor device for conveying the case, the lower machine core being generally fixed provided on a machine seat and below the conveyor device. The adhesive tape of the lower machine core is needed to be replaced when the adhesive tape within the lower machine core is used up. The following steps is carried out to replace the adhesive tape of the lower machine core: opening a safety door; separating two conveyor belts; lifting up a machine head; detaching the lower machine core from the machine seat; replacing the adhesive tape; reassembling the lower machine core; adjusting the lower machine core to a suitable height; adjusting a distance between the two conveyor belts; and closing the safety door. Disadvantages can be obviously seen because of that it usually needs several minutes to finish those steps even by a well-skilled operator through professional training: operating steps are too many, replacement of the adhesive tape is inconvenient, and efficiency of operations is low. The replacement for one lower machine core may generally lead to hundreds of cases waiting at the assembly line.

SUMMARY

The present invention is proposed focusing on the above-mentioned problems, and is aimed at providing an adhesive tape case sealer machine for quickly replacing the adhesive tape of the lower machine core.

To solve the above-mentioned technical problems, the present invention provides an adhesive tape case sealer machine comprising a machine seat, an upper machine core provided on the machine seat for sealing the upper part of the case with the adhesive tape, a lower machine core provided on the machine seat for sealing the lower part of the case with the adhesive tape, and a conveyor device located below the upper machine core for conveying the case, a slide track being provided on the is machine seat, the lower machine core being slidingly provided on the slide track of the machine seat below the conveyor device, and having at least two working positions, wherein the lower machine core lies in the inner side of the machine seat and below the conveyor device when in a first working position, and at least a part of the lower machine core slides out of the machine seat and the lower machine core can slide towards the first working position with respect to the machine seat when in a second working position. By sliding the lower machine core below the conveyor device, the lower machine core can be pulled out from the machine seat, and in this case, quickly replacing and installing the adhesive tape of the lower machine core can be achieved.

Preferably, the sliding direction of the lower machine core with respect to the machine seat is perpendicular to a direction in which the case is conveyed by the conveyor device.

Preferably, the lower machine core comprises a machine core support, a machine core side plate, an adhesive tape installation device, a pressure roller device and a tape cutting device, the machine core support being slidingly connected to the slide track, and the machine core side plate, the adhesive tape installation device, the pressure roller device and the tape cutting device being fixed provided on the machine core support. When the lower machine core is in the first working position, the adhesive tape installation device, the pressure roller device and the tape cutting device are located substantially right below the conveyor device for conveniently sealing the lower part of the case with the adhesive tape.

Further preferably, the lower machine core is locked to the machine seat via a lock mechanism, the lock mechanism comprising a stop block rotatably provided on the machine core support, a handle provided on the machine core support and in linkage with the stop block to control the rotation of the stop block and a groove provided on the machine seat and is matching up with the stop block, wherein the lock mechanism has a lock state in which the stop block is stuck in the groove and an unlock state in which the stop block leaves away from the groove. When required to replace the adhesive tape, the lock mechanism is turned to the unlock state and the lower machine core is slided out of the machine seat to replace the adhesive tape, and after replacing the adhesive tape, the lock mechanism is keeped in the unlock state to slide the lower machine core back into the machine seat.

Furthermore, when the lower machine core is in the first working position, it is better for the lock mechanism to lock the lower machine core to the machine seat for preventing the lower machine core from sliding out during the work of the case sealer machine, effectively avoiding leakage or deviation of the adhesive tape sealing.

Further preferably, the adhesive tape case sealer machine further comprises a first linear slide track fixed provided on the machine seat and a second linear slide track installed on the machine core support of the lower machine core, wherein the first linear slide track and the second linear slide track butt together and form a track for conveying the case by co-action when the lower machine core is in the first working position.

Further preferably, the machine seat further comprises a travel switch for controlling the conveyor device to lift and fall, wherein the machine core support touches the travel switch causing the conveyor device falling down onto the machine seat when the lower machine core slides to the first working position from the second working position, and the machine core support leaves away from the travel switch causing the conveyor device lifting up for a distance when the lower machine core slides away from the first working position and towards the second working position. It is conceivable that the travel switch may also be provided on the lower machine core, the travel switch touches the machine seat when the lower machine core slides to the first working position from the second working position, and the travel switch is away from the machine seat when the lower machine core slides away from the first working position and towards the second working position.

The present invention employing the above-mentioned structures has the following advantages:

1. by slidingly providing the lower machine core for sealing the lower part of the case on the machine seat, when required to replace the adhesive tape, the lower machine core may be pulled out to replace the adhesive tape, and thus replacing the adhesive tape is convenient, efficiency of operations is high, and it is more suitable for high-speed, large-scaled assembly link operation; the used time for replacing the machine core may be shortened to less than 10 seconds from original 3-5 minutes, and this significantly shortens the shutdown time of the assembly line and it generally does not need to shutdown;

2. when the lower machine core is in the first working position, the lower machine core is locked to the machine seat via the lock mechanism for preventing the lower machine core from sliding out during the work of the case sealer machine, and it is effective to prevent leakage or deviation of the adhesive tape sealing, and the adhesive tape case sealer machine has stable working performance;

3. when pulling out the lower machine core, the conveyor device lifts up due to that the machine core support leaves away from the travel switch, so that the lower machine core may be pulled out smoothly to effectively avoid the situation that the lower machine core is stuck and cannot be pulled out;

4. due to that the travel switch is used so that electromechanical elements and pneumatic elements are combined together to match up with each other, when the lower machine core is pulled out, the conveyor belt automatically stops and the conveyor device automatically lifts so that the lower machine core device can be pulled out and the electrical machine then stops running, and meanwhile the electrical machine cannot be restarted even that the start switch is pressed, and the electrical machine may be restarted until the lower machine core returns back to the first working position, with higher safety performance.

wherein: 1. machine seat; 3. lower machine core; 31. lock mechanism; 311. stop block; 312. handle; 313. groove; 32. machine core support; 33. machine core side plate; 34. adhesive tape installation device; 35. pressure roller device; 36. tape cutting device; 4. conveyor device; 51. first linear slide track; 52. second linear slide track; 6. travel switch; 7. air cylinder.

DETAIL DESCRIPTION OF EMBODIMENTS

In the following, the preferable embodiments of the present invention are explained in detail combining with the accompanying drawings so that the advantages and features of the present invention can be easily understood by the skilled persons in the art, and thus it is clear to define the protective scope of the present invention.

Embodiments

An adhesive tape case sealer machine with reference to FIGS. 1 to 5, comprises a machine seat 1, an upper machine core (not shown in the figures) provided on the upper portion of the machine seat 1 for sealing the upper part of the case, a lower machine core 3 provided on the lower portion of the machine seat 1 for sealing the lower part of the case, and a conveyor device 4 for conveying the case, wherein adhesive tapes are provided within the upper machine core and the lower machine core 3, and the conveyor device 4 is below the upper machine core.

Due to that the upper machine core is not the main point of the present invention and the structure of the upper machine core is already familiar to the skilled persons in the art, the upper machine core will therefore not be discussed herein.

Figure 1:
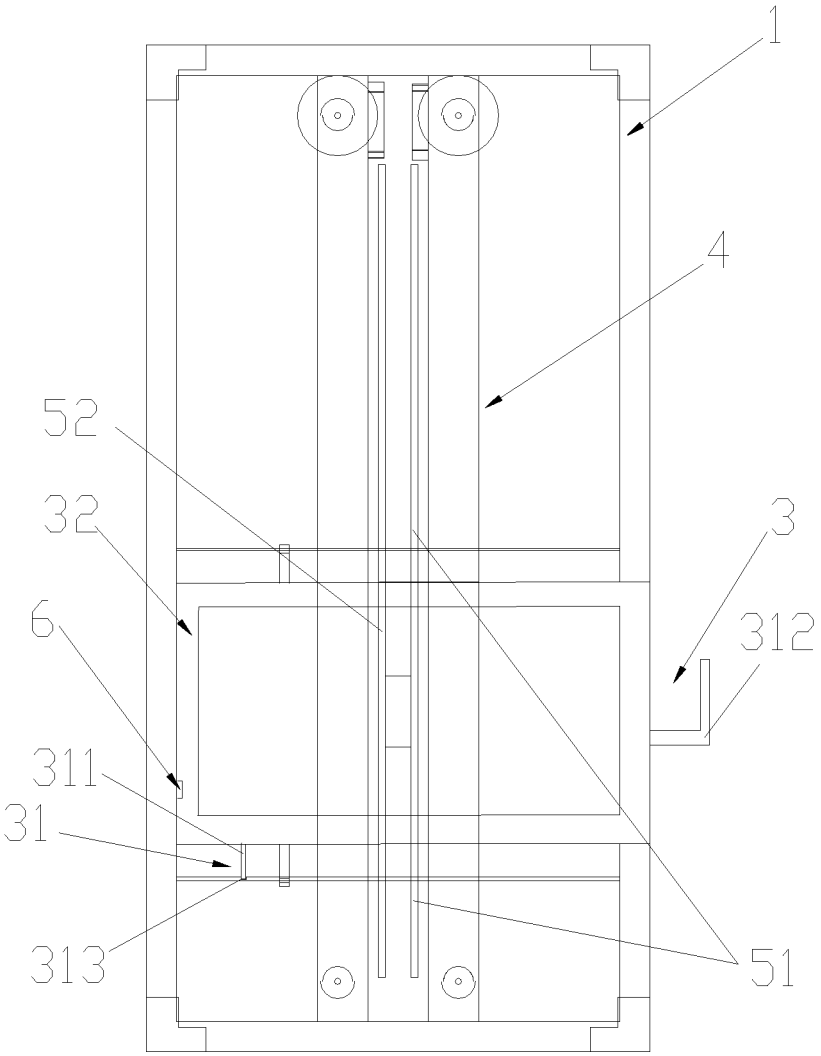
FIG. 1 is a structure schematic diagram of an adhesive tape case sealer machine of the present invention whose lock mechanism is in lock state.
Figure 2:
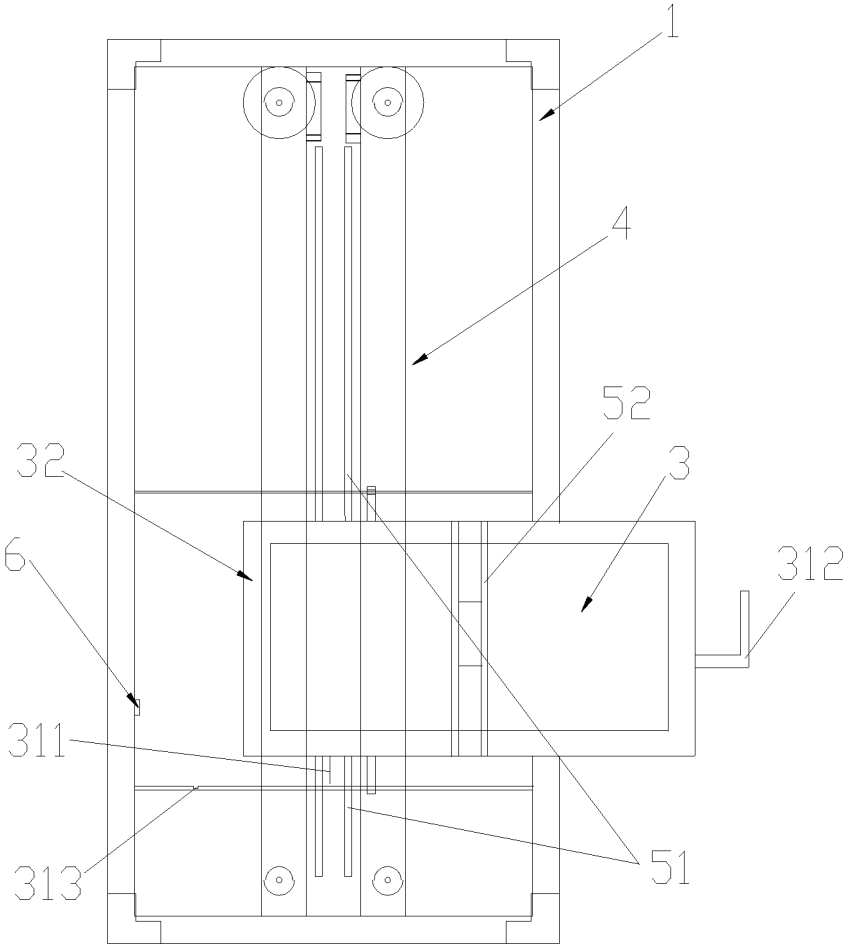
FIG. 2 is a structure schematic diagram of the adhesive tape case sealer machine of the present invention whose lock mechanism is in unlock state.

A slide track is provided on the machine seat 1, and the lower machine core 3 is slidingly provided on the slide track of the machine seat 1 below the conveyor device 4. The slide track is a commonly used part of mechanical equipment, and thus is not shown in the figures. The lower machine core 3 has at least two working positions. The lower machine core 3 lies in the inner side of the machine seat 1 and below the conveyor device 4 when in a first working position, as shown in FIG. 1; at least a part of the lower machine core 3 slides out of the machine seat 1 and it allows the lower machine core 3 to slide towards the first working position with respect to the machine seat 1 when in a second working position, as shown in FIG. 2.

In the preferable embodiments of FIGS. 1-5, the sliding direction of the lower machine core 3 with respect to the machine seat 1 is perpendicular to a direction in which the case is conveyed by the conveyor device 4, and the sliding direction of the lower machine core 3 is substantially parallel to horizontal plane.

The lower machine core 3 is locked to the machine seat 1 via a lock mechanism 31, wherein the lower machine core 3 can slide with respect to the machine seat 1 when the lock mechanism 31 is in an unlock state, and the lower machine core 3 is fixed with respect to the machine seat 1 is when the lock mechanism 31 is in a lock state.

Figure 3:
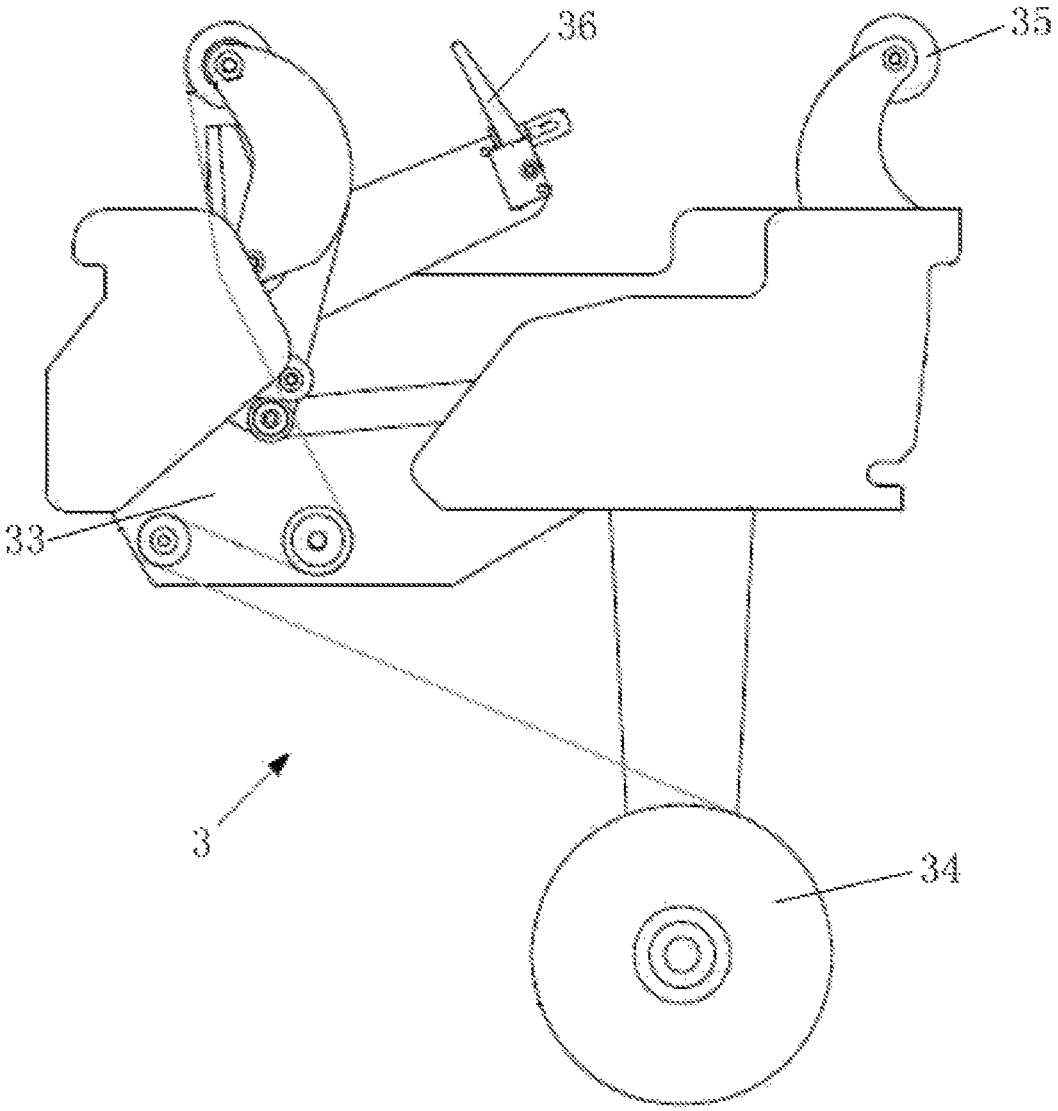
FIG. 3 is a side view of a part of a lower machine core of the present invention.

As shown in FIG. 3, the lower machine core 3 comprises a machine core support 32, a machine core side plate 33, an adhesive tape installation device 34, a pressure roller device 35 and a tape cutting device 36, wherein the machine core support 32 is connected to the slide track and may slide along the slide track, and the machine core side plate 33, the adhesive tape installation device 34, the pressure roller device 35 and the tape cutting device 36 are fixed provided on the machine core support 32. When the lower machine core 3 is in the first working position, the adhesive tape installation device 34, the pressure roller device 34 and the tape cutting device 36 are located substantially right below the conveyor device 4. Due to that the machine core side plate 33, the adhesive tape installation device 34, the pressure roller device 35 and the tape cutting device 36 are of prior arts, and thus will not shown in the figures in detail.

The lock mechanism 31 comprises a stop block 311 rotatably provided on the machine core support 32, a handle 312 provided on the machine core support 32 and in linkage with the stop block 311 to control the rotation or moving of the stop block 311, and a groove 313 provided on the machine seat 1 matching up with the stop block 311. By rotating the handle 312 to keep the stop block 311 away from the groove 313, the lock mechanism 31 is turned to be unlocked; by rotating or moving the stop block 311 into the groove 313 and to be stuck in the groove 313 via the handle 312, the lock mechanism 31 turns to the lock state.

When the lower machine core 3 is in the first working position, it is better for the lock mechanism 31 to lock the lower machine core 3 to the machine seat 1. The adhesive tape case sealer machine as shown in FIG. 1-2 further comprises a first linear slide track 51 fixed provided on the machine seat 1 and a second linear slide track 52 installed on the machine core support 32 of the lower machine core 3, wherein the first linear slide track 51 and the second linear slide track 52 butt together and form a track for conveying the case by co-action when the lower machine core 3 is in the first working position, as shown in FIG. 1; and the second linear slide track 52 slides and leaves away from the first linear slide track 51 as the lower machine core 3 slides out of the machine seat 1, as shown in FIG. 2.

Figure 4:
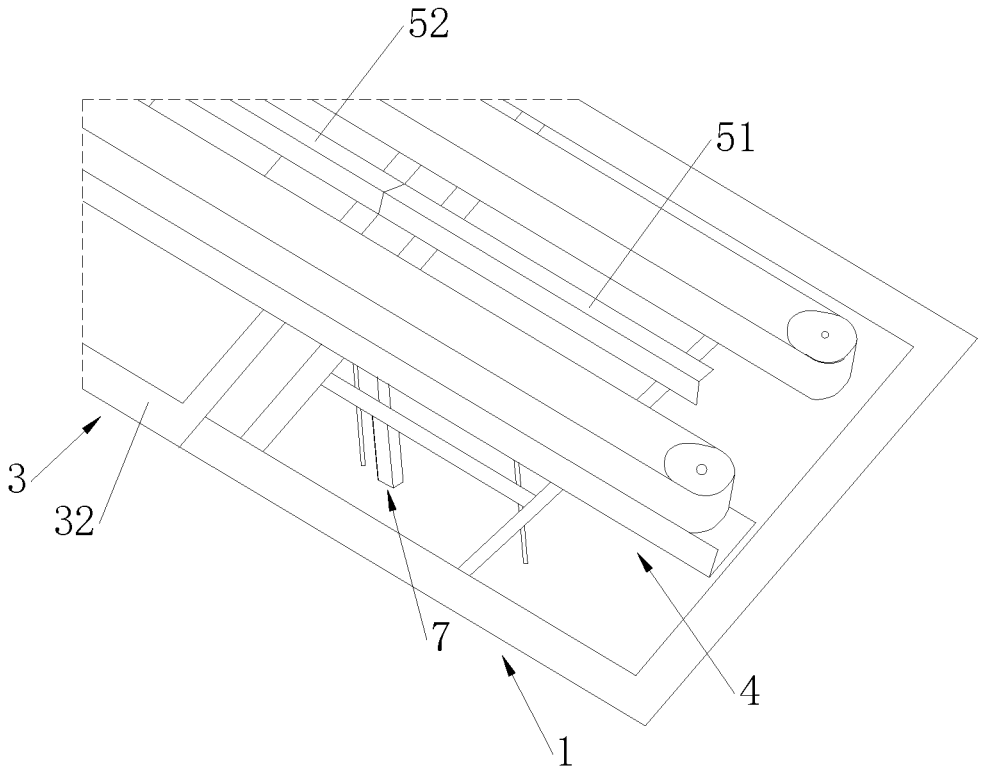
FIG. 4 is a stereogram of an adhesive tape case sealer machine of the present invention, wherein the conveyor device falls down onto the machine seat.
Figure 5:
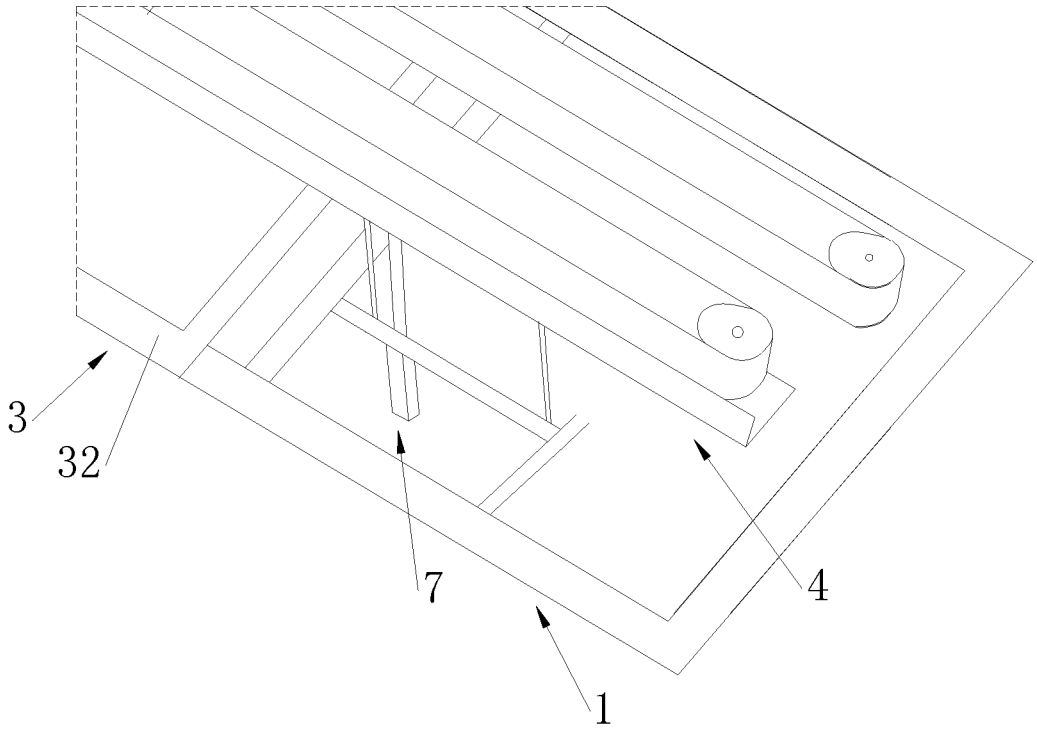
FIG. 5 is a stereogram of an adhesive tape case sealer machine of the present invention, wherein the conveyor device lifts up for a distance.

As shown in FIGS. 4 and 5. the machine seat 1 is further provided with a travel switch 6 for controlling the conveyor device 4 to lift and fall, the travel switch 6 being provided on the portion of the machine seat 1 corresponding to the machine core support 32 of the lower machine core 3, wherein the travel switch 6 controls the electrical machine for driving the conveyor device and the conveyor device 4 via an air cylinder 7. When the lower machine core 3 slides from the first working position to the second working position, the machine core support 32 leaves away from the travel switch 6, the electrical machine for driving the conveyor device stops running, and the conveyor device 4 lifts up for a distance from the machine seat; when the lower machine core 3 slides back to the first working position, the machine core support 32 touches the travel switch 6 and the conveyor device 4 falls down onto the machine seat 1. Due to that the conveyor device 4 lifts up when the lower machine core leaves the first working position and slides towards the outside of the machine seat 1, the lower machine core 3 can thus slide without hindrance and be smoothly pulled out to replace the adhesive tape, effectively avoiding the situation that the lower machine core 3 is stuck by the conveyor device 4 and cannot be pulled out. Furthermore, the travel switch 6 is used so that electrical elements and mechanical elements are combined together, the conveyor belt of the conveyor device and the electrical machine automatically stop running when the lower machine core 3 is pulled out, with higher safety performance.

The above mentioned embodiments are only for explaining the technical concepts and feathers of the present invention, and are preferable embodiments which are intended to enable the persons familiar with this technique to understand the content of the present invention and implement it hereby, and thus it should not be concluded to limit the scope range of the present invention. Any equivalent variations or modifications according to the spirits of the present invention should be covered by the scope of the present invention.

What is claimed is:

1. An adhesive tape case sealer machine, comprising:

a machine seat, an upper machine core provided on the machine seat for sealing the upper part of the case with the adhesive tape, a lower machine core provided on the machine seat for sealing the lower part of the case with the adhesive tape, and a conveyor device located below the upper machine core for conveying the case, wherein:

a slide track is provided on the machine seat, the lower machine core is slidingly provided on the slide track of the machine seat below the conveyor device, and the lower machine core has at least two working positions; wherein the lower machine core is inside of the machine seat and below the conveyor device when in a first working position, while at least a part of the lower machine core slides out of the machine seat and the lower machine core can slide towards the first working position with respect to the machine seat when in a second working position;

the lower machine core comprises a machine core support, a machine core side plate, an adhesive tape installation device, a pressure roller device and a tape cutting device, the machine core support being slidingly connected to the slide track, and the machine core side plate, the adhesive tape installation device, the pressure roller device and the tape cutting device being fixedly provided on the machine core support, wherein the adhesive tape installation device, the pressure roller device and the tape cutting device are substantially below the conveyor device when the lower machine core is in the first working position;

the machine seat further comprises a travel switch for controlling an air cylinder for causing lifting up and falling down of the conveyor device, wherein when the lower machine core slides to the first working position from the second working position the machine core support engages with the travel switch controlling the air cylinder for causing falling down of the conveyor device onto the machine seat, and wherein when the lower machine core slides away from the first working position and towards the second working position the machine core support disengages from the travel switch controlling the air cylinder for causing lifting up of the conveyor device for a distance from the machine seat.

2. The adhesive tape case sealer machine as claimed in claim 1, wherein the sliding direction of the lower machine core with respect to the machine seat is perpendicular to a direction in which the case is conveyed by the conveyor device.

3. The adhesive tape case sealer machine as claimed in claim 1, wherein the lower machine core is lockable to the machine seat via a lock mechanism, the lock mechanism comprising a stop block rotatably provided on the machine core support, a handle provided on the machine core support and linked with the stop block to control the rotation of the stop block, and a groove provided on the machine seat and matching up with the stop block, wherein the lock mechanism has a locked state in which the stop block is rotated into the groove and an unlocked state in which the stop block is rotated out of the groove.

4. The adhesive tape case sealer machine as claimed in claim 3, wherein the lock mechanism locks the lower machine core to the machine seat when the lower machine core is in the first working position.

5. The adhesive tape case sealer machine as claimed in claim 1, further comprises a first linear slide track fixedly provided on the machine seat and a second linear slide track installed on the machine core support of the lower machine core, wherein the first linear slide track and the second linear slide track butt together and form a track for guiding the case by co-action when the lower machine core is in the first working position.

* * * * *